US005625996A

United States Patent [19]

Bechtel

[11] Patent Number: 5,625,996

[45] Date of Patent: May 6, 1997

[54] FIRE RESISTANT WOOD BOX BEAM

[76] Inventor: Friend K. Bechtel, 1523 Borah, Moscow, Id. 83843

[21] Appl. No.: 519,790

[22] Filed: Aug. 28, 1995

[51] Int. Cl.[6] ..... E04C 3/12; E04C 3/29

[52] U.S. Cl. ..... 52/731.2; 52/730.7; 52/732.1; 52/737.6; 52/738.1

[58] Field of Search ..... 52/730.7, 731.2, 52/732.1, 737.6, 738.1, 730.1, 783.11, 787.1, 787.11, 797.1, DIG. 8, 690, 692, 696

[56] References Cited

U.S. PATENT DOCUMENTS

| | | | |
|---|---|---|---|
| 1,368,594 | 2/1921 | Aatila | 52/730.7 X |
| 1,552,474 | 9/1925 | Dornier | 52/731.2 X |
| 2,074,463 | 3/1937 | Davis | 52/DIG. 8 X |
| 4,854,107 | 8/1989 | Roberts | 52/DIG. 8 X |

FOREIGN PATENT DOCUMENTS

| | | | |
|---|---|---|---|
| 2515597 | 10/1976 | Germany | 52/DIG. 8 |
| 2030625 | 4/1980 | United Kingdom | 52/512 |

OTHER PUBLICATIONS

National Evaluation Service, Inc. Report No. NER-405.

James Hardie Bldg. Products Brochure "Hardibacker Fiber Cement Interior Underlayment".

James Hardie Bldg Products Brochure "Hardiplank/Hardipanel Non-Combustible Fiber-Cement Exterior Siding".

Walker, Jerry A., "Gypsum—The Miracle Mineral Brief History and Prospects".

Lempfer, Karsten H., "Technology Trends in Gypsum Fiberboard".

Kozlowski et al, "Light-weight, Environmentally Friendly, Fire Retardant Composite Boards for Paneling and Construction".

Englert et al, "Properties of Gypsum Fiberboard Made by the USG Process".

*Primary Examiner*—Carl D. Friedman
*Assistant Examiner*—Kevin D. Wilkens

[57] ABSTRACT

A box beam has an interior and an exterior. Fire resistance is obtained by preventing the rapid progression of fire from the exterior to the interior. Fire resistant covers for the web elements and sufficiently sized wood flanges protect the interior of the beam, thus giving it improved fire safety. In some instances, longitudinal reinforcement elements embedded in protected areas of the flanges are desirable to provide additional stiffness and strength.

10 Claims, 4 Drawing Sheets

FIRE RESISTANT WOOD BOX BEAM

TECHNICAL FIELD

This invention relates to a wood box beam that is more fire resistant than ordinary wood box beams.

BACKGROUND OF THE INVENTION

Wood has many advantages for structural uses. It is a renewable resource available in many parts of the world, it is easily machined to size and shape by semiskilled craftsmen using ordinary tools, it occurs naturally in large sizes, it is durable if protected from moisture or chemically treated and it is relatively light when compared with other structural materials.

In recent years, for a number of reasons, the availability of sawn wood in large sizes has diminished. This has led to the development and use of manufactured composite products such as laminated wood beams, laminated veneer lumber and other products that achieve the benefits of large size from smaller, less costly and more readily available constituent elements.

A perceived disadvantage of wood beams in structures is the combustibility of wood and therefore its potential to contribute to the spreading of fire. However:

"Timber behaves better in a fire than is often believed. It burns at the slow and fairly steady rate of 1/40 inch per minute in furnaces prescribed for American and British standard tests. It thus takes an appreciable time for a member to be sufficiently depleted to collapse, and the time, of course, increases with the size of the member."

This quote is taken from *Laminated Timber,* Project No. 113, European Productivity Agency of the Organization for European Economic Cooperation, March, 1953.

Other tests have shown that structures whose main supporting elements are wood beams are safer in the event of fire than equivalent buildings where the main supporting elements are steel beams. While these facts may seem to contradict common sense, they are well known to fire fighting professionals. In fires, wood beams char on their exteriors; but, this protects the interiors which continue to support the load. In the case of steel beams, the heat of a fire rapidly progresses through the beam, and the stiffness and strength diminish. This can cause an early structural collapse when the strength reduces below the value required to support the applied load.

Thus, rather than being a disadvantage, one of the primary advantages of using large wood beams in structures is the fire safety of such structures. In a building supported by large wood beams, firemen know that they have more time to rescue inhabitants and fight a fire before structural collapse than in an equivalent building using steel beams.

Laminated wood beams also have been shown to perform well in fires: "Findings from a simultaneous fire exposure of an unprotected glued laminated timber beam and a steel beam," American Institute of Timber Construction, 1961, Report of Southwest Research Institute test sponsored by the National Lumber Manufacturers Association (now American Forest and Paper Association).

Laminated beams, as well as having the advantage of using more readily available constituents, also have the statistical advantage of randomizing the locations and thereby reducing the seriousness of defects occurring naturally in wood. Thus laminated wood beams have become popular in many applications.

The large cross-sectional sizes of sawn and laminated wood beams allow them to perform well in resisting bending loads because of their moment resisting ability. The beam geometry allows the outer fibers in the plane of bending to resist bending moments with reduced stress both in tension and in compression. Between the outer fibers the shear properties of wood are sufficient to tie the outer fibers together so that the beam acts as a single unit in bending rather than as a deck of cards wherein bending loads cause a slippage of one card relative to another due to shear forces.

Several designs have been implemented in the building trades to achieve the structural advantages of large wood beams but without using as much wood. One example is the parallel chord truss used primarily in floors and flat roof systems where two long pieces of small sized lumber (the chords) are spaced parallel to one another and fastened to and braced apart with short struts (web elements). The struts are designed and positioned to resist the shear forces, and the chord elements, also known as flanges, resist the compression and tension forces resulting from bending loads applied to the truss. By properly selecting the distance of separation between the flanges, the truss can be made to be stiffer in bending and to withstand a significantly greater load than if the flanges had been joined together with no space between them. Thus, the parallel chord truss can take on the job of a heavier sawn or laminated wood beam that would use more wood. Many truss manufacturers offer parallel chord trusses as one of their structural component products.

Another structural component that achieves many of the advantages of a wood beam is the I joist. I joists are now made by a number of manufacturers. An I joist consists of two parallel flange elements, spaced apart by a web element so that the cross-sectional shape resembles the capital letter I where the flanges are the top and bottom of the I and the web is the vertical stem. The flanges are typically either solid sawn lumber or laminated veneer lumber (LVL). The web is typically plywood or oriented strand board (OSB). Joining of the flanges to the web is typically accomplished by gluing the edges of the web element into mating grooves cut into the center of one face of each of the flange elements. Both LVL and the I joist are products pioneered by the Trus Joist Corporation, now Trus Joist MacMillan, in Boise, Id.

The I joist and parallel chord floor truss concepts are similar in that they both achieve their structural values by using a web means for resisting shear forces, for supporting concentrated loads perpendicularly aligned to the beam and to space apart upper and lower flange means that resist compression and tension forces.

Another example of this concept, and the subject of the present disclosure, is the wood box beam. The wood box beam consists of two flange elements, usually, but not necessarily parallel, and two plane panel web elements also usually, but not necessarily, parallel. If the flange elements and the web elements are parallel, the box beam takes on the shape of a rectangular prism. Sometimes the bending moments in the beam are known to be less and the shear forces greater near the ends of the beam than in the middle. In those cases it may be advantageous to reduce the cross-sectional size near the ends of the beam thereby deviating from the usual prismatic shape. The web elements are rigidly fastened to the edges of the flanges typically by gluing, nailing or both. The cross section of the box beam is a closed shape which, in the usual case of a rectangular prismatic beam, is a rectangle or box; hence its name.

Because the box beam has a closed cross-sectional shape, it has much more rigidity in torsion than an I joist. Further, the two web elements and the space between them allow more options in design for resisting shear forces. For example, struts can be included between the plane panel web elements. These struts may be required in some applications to allow the box beam to withstand either or both of greater shear forces or concentrated loads.

None of the parallel chord truss, the I joist or the box beam has the fire safety advantages of a solid wood beam having equivalent structural capabilities. Consequently, the building systems in which they are used must compensate by providing fire stops or otherwise slowing the spread of flames through the structure.

Advantages of the Present Invention over the Prior Art

The box beam of the present invention retains its structural value longer when exposed to fire than either the parallel chord truss, the I joist or ordinary box beams. As an additional benefit, reinforcement can be added to increase the strength and stiffness of the beam in bending.

In some applications exposed beams are preferred for aesthetic reasons, and fire resistant box beams can serve in this application. For example in a residential basement, where the ceiling is the main floor for the structure above, the supporting joists could be wood I-joists. To give the system additional fire safety, a fire resistant plane covering, such as gypsum wall board, can be fastened to the lower surface of the I-joists. Alternatively, if fire resistant box beams are used for the supporting joists, an additional fire resistant cover may be unnecessary. Then the exposed box beams have the spaces between them as extra ceiling height contributing to the feeling of spaciousness as well as providing the appearance of a beam supported ceiling.

DESCRIPTION OF THE PREFERRED EMBODIMENT

The preferred embodiment of the invention is illustrated in the accompanying drawings. It is to be understood that the fire resistant box beams illustrated are merely examples of physical embodiments of the present invention. The illustrations and description that follow are not intended to limit or restrict the scope of the invention except as that scope is defined in the claims.

Figure 1:
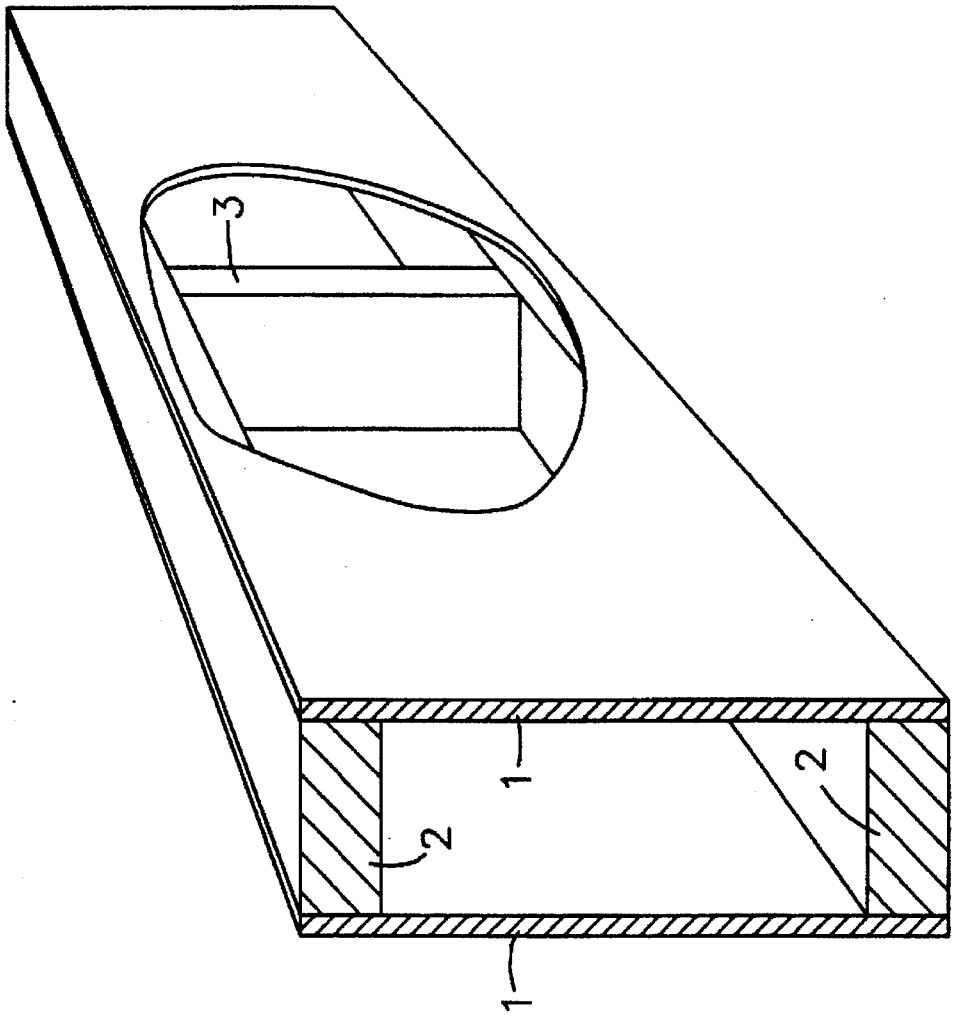
FIG 1 PRIOR ART
FIG 1 prior art is a cross-sectional view of a simple box beam along with a perspective continuation showing the length of the beam.

Referring to FIG. 1, which is representative of the prior art, plane panel web elements 1 are rigidly glued and nailed to the edges of flange elements 2 thus forming a rectangular prism having a rectangular cross-sectional shape. Typically, there will be wood struts located in the region between the web and flange elements at points along the length of the beam where it is subjected to concentrated loads. In FIG. 1, a wood strut 3 is illustrated through a cut-away area of one web element. While not illustrated in FIG. 1, a wood strut often will be required at the ends of the box beam to help withstand the concentrated loads and the high shear loads occurring there.

As examples of materials that could be used, the plane panel web elements 1 can be of lignocellulosic material having structural quality such as plywood or oriented strand board (OSB), and the flange elements 2 and wood struts 3 can be solid sawn lumber or laminated veneer lumber (LVL). The glued and nailed assembly as shown can be assembled by semiskilled persons using rudimentary tools. The glue can be structural adhesive and applied by glue spreader, caulking gun or other methods known to those skilled in the art. Either nails or other clamping means is required to maintain pressure at the glue lines. The structural properties of the box beam of FIG. 1 are determined by well known methods from the properties of the web and flange elements and the geometry of their assembly. Two excellent reference texts are "Wood Technology in the Design of Structures" by Hoyle and Woeste, Iowa State University Press, 1989, and "Wood Engineering and Construction Handbook" by Faherty and Williamson, McGraw-Hill, 1995.

It is to be understood that more automated processes for assembly are possible where combinations of adhesive, pressure and heat may be applied to achieve the rigid connections of web elements to flange elements either with or without the use of nails.

Figure 2:
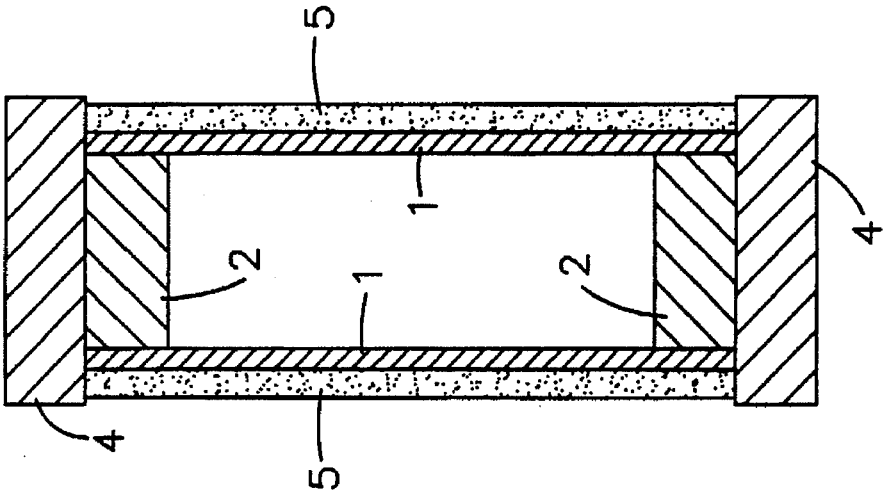
FIG. 2 is a cross-sectional view of a fire resistant box beam having protective web covers and secondary flange elements.

Typically, the web elements 1 might be quite thin, e.g. ½ inch [12.7 mm]. In a fire, unless additionally protected, the web elements would quickly burn through, and the box beam would lose its ability to carry loads. FIG. 2 illustrates the cross section of one embodiment of a fire resistant box beam. The web and flange elements 1 and 2 are arranged as previously, but secondary flange elements 4 and fire resistant web covers 5 have been added. The secondary flange elements 4 can be of the same type of wood material as used for primary flanges 2, but the web covers 5 must be of fire resistant material such as gypsum wall board or gypsum fiber board available e.g. from Fermacell in Seseen, Germany. One method for fastening the additional elements 4 and 5 is by glue and nails.

The fire resistant web covers 5 retard the spread of heat and flame into the vulnerable web elements 1. The secondary flange elements 4 retard the spread of fire into the flange elements 2. These additional elements significantly slow the reduction in strength of the fire resistant box beam when it is subjected to fire. The effect is that the fire resistant box beam presents thickened flange areas and fire resistant web areas to the flames. It will be clear to those skilled in the art that the stiffness and strength of the box beam are significantly improved by the addition of the secondary flange elements and fire resistant web covers. While some of this may be necessary to achieve a given fire rating, it may be possible, depending on the application and results of structural calculations, to reduce the size of the cross section and/or to use lower grades of wood for the flanges. These are cost reducing steps that can help make up for the additional cost incurred by introducing the fire protective elements to the box beam.

The terms flange element and secondary flange element have been used to describe this specific preferred embodiment. However, it is to be understood that the concept to be achieved by this invention is to make the flange parts of the box beam large enough to retard the strength and stiffness reducing effects of fire in these members and to protect the web parts of the box beam with fire resistant material. This concept can be applied to beams that are not prismatic as well as to those that are.

By construction, fire does not have access to the interior of the box beam except if the closed form of the box is breached by fire or by structural failure of the beam. The present specification teaches construction of a box beam so that its exterior which would be exposed in the event of fire will greatly retard the progression of fire to the interior of the beam, thus greatly retarding structural failure of the beam under bending loads. One of the advantages of the box beam method of construction is in the separation of interior and exterior portions of the beam. The present invention strives to retain that separation for as long as possible in the presence of fire, thereby making the box beam behave more like a solid beam having equivalent load carrying capability.

Figure 3:
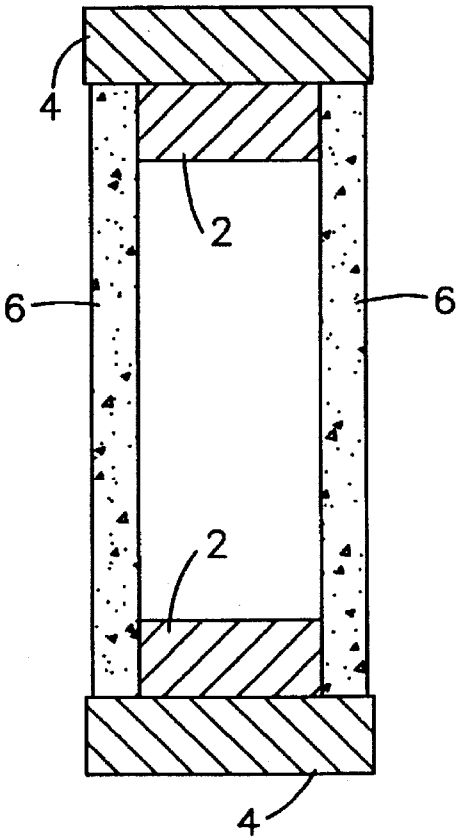
FIG. 3 is a cross-sectional view of a fire resistant box beam having web elements that are themselves made of fire resistant material.

As an alternative to covering the web elements with fire resistant web covers as in FIG. 2, in some cases, one can use fire resistant material as the web elements. FIG. 3 illustrates a fire resistant box beam where fire resistant web elements 6 are used without any other protective cover. These web elements 6 must initially have the required strength properties, and they must retain these properties sufficiently long in the presence of fire. Gypsum fiber board is a candidate for the web elements 6 provided the computed loads do not exceed the ratings of these web elements.

Figure 4:
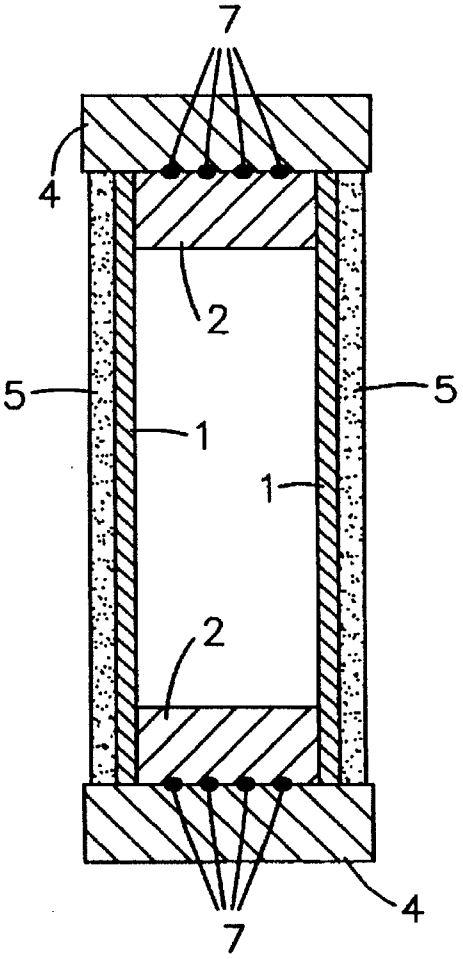
FIG. 4 is a cross-sectional view of a fire resistant box beam having, in addition, longitudinal reinforcement elements for extra stiffness and strength.

FIG. 4 illustrates the cross section of a fire resistant box beam as in FIG. 2 where longitudinal reinforcement elements 7 have been added in an area protected from heat and flame. The longitudinal reinforcement can be steel straps or rods, or it can be carbon, glass or other fiber. Its purpose is to give the box beam additional stiffness and strength in bending, thereby lending additional structural value to the beam. By nature of their location between the flange element 2 and the secondary flange element 4, the reinforcement elements 7 are protected from fire and insulated from a rapid rise in temperature in the event of fire.

Depending on the size of the longitudinal reinforcement elements and the type of glue used, they can be inserted in the glue bond and pressed between the flange 2 and the secondary flange 4 elements. Alternatively, grooves can be cut in one or the other or both of the flange or secondary flange elements to accept the reinforcement. The view in FIG. 4 illustrates the cross-section of longitudinal reinforcement elements placed in grooves cut in the flange 2 and secondary flange 4 elements. These longitudinal reinforcement elements extend from one end to the other of the box beam and are bonded to the flange and secondary flange elements throughout their length.

It is important that a compatible adhesive be selected so that the longitudinal reinforcement elements bond to the flange and/or secondary flange elements. Additional fastening can be accomplished with nails or staples. The objective is that the beam should transfer forces to the longitudinal reinforcement elements without them slipping relative to the beam where they are located.

Figure 5:
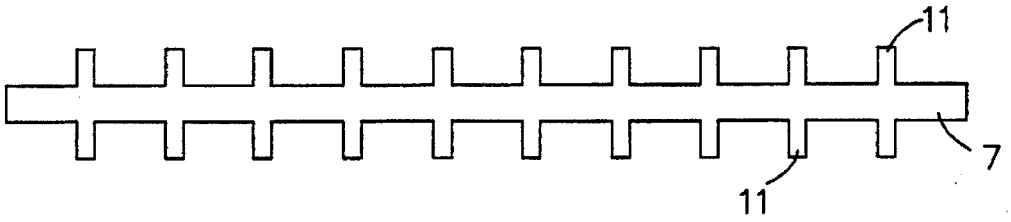
FIG. 5 is a plan view of a longitudinal reinforcement element and ribs.
Figure 6:
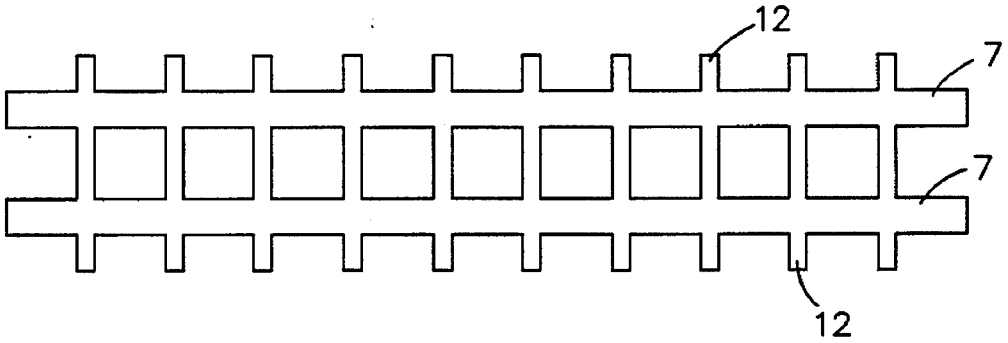
FIG. 6 is a plan view of a longitudinal reinforcement mesh.

Another method for helping ensure a proper attachment of the longitudinal reinforcement elements to the flange and/or secondary flange elements is to arrange the longitudinal reinforcement elements with ribs or a mesh. Referring to FIG. 5, ribs 11 are attached in a perpendicular direction to longitudinal reinforcement element 7. FIG. 6 illustrates a mesh arrangement consisting of longitudinal reinforcement elements 7 together with cross elements 12 to form the mesh. When the longitudinal reinforcement elements are pressed into the adhesive interface between the flange and secondary flange elements, the ribs or mesh will prevent relative longitudinal movement much as the ribs on steel reinforcing rods for concrete prevent relative longitudinal movement between the rods and the concrete.

In the case of the rib arrangement of FIG. 5, the plane defined by the longitudinal reinforcement element 7 and the ribs 11 can either coincide with the plane of the adhesive interface between the flange elements or, if the ribs are made of steel or other material rigid in compression, these planes can be perpendicular to one another. In the latter case, the longitudinal reinforcement element 7 lies in the plane of the adhesive interface and the ribs are pressed into the opposing faces of the flange elements.

Figure 7:
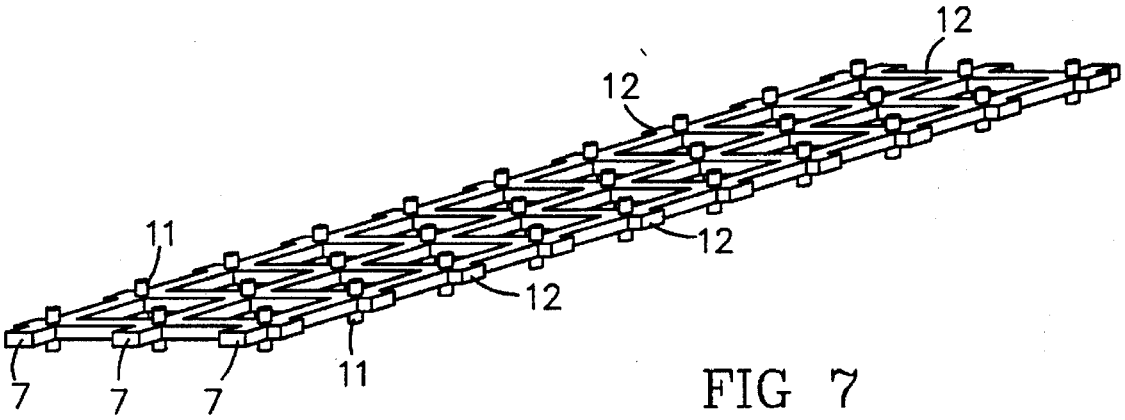
FIG. 7 is an isometric view of a combination longitudinal reinforcement.

FIG. 7 illustrates a longitudinal reinforcement where a mesh consisting of longitudinal reinforcement elements 7 and cross elements 12 are combined with ribs 11 at right angles to the mesh. The longitudinal reinforcement of FIG. 7 can be fabricated much as a conventional steel nail plate but with nails coming out both sides of the plate and with the plate running the full length of the flange elements. Usually, however, it will be found that more steel for the longitudinal reinforcement elements 7 is required for large improvements in strength and stiffness than is available with conventional nail plate thickness. When the flange elements are pressed together with the longitudinal reinforcement of FIG. 7 and bonded, the ribs are pressed into the flange elements thereby holding the longitudinal reinforcement firmly in place as well as helping to hold the flange elements together.

Figure 8:
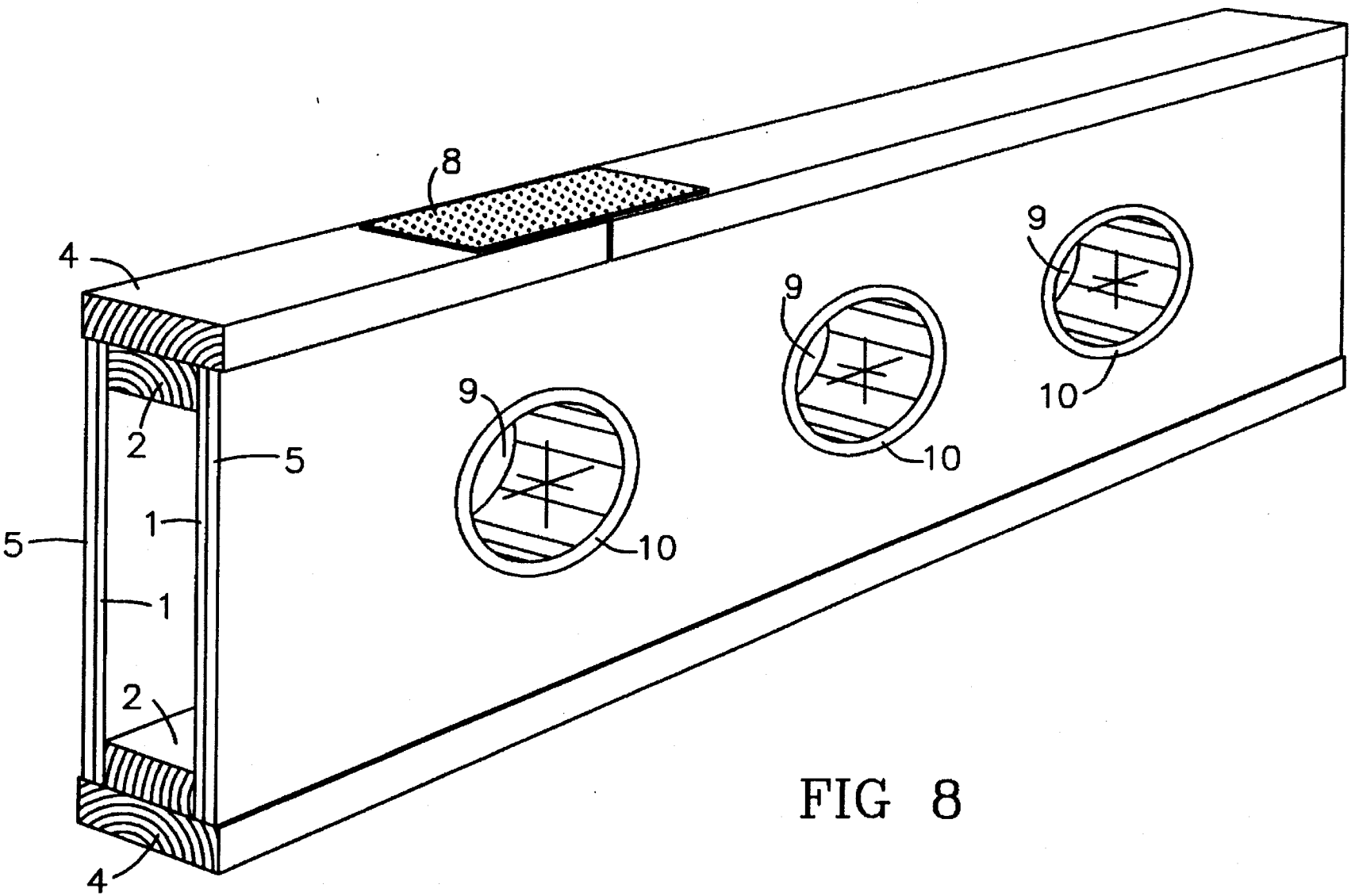
FIG. 8 is a perspective view of a fire resistant box beam illustrating a nail-plated end joint and utility holes.

FIG. 8 illustrates the fire resistant box beam of FIG. 2 with an isometric view. For this view it is assumed that the flange material is solid sawn lumber, and a nail plate 8 is illustrated on the outside of the upper secondary flange to join the ends of two pieces of the upper secondary flange. Usually, there also will be a matching nail plate on the underside of the upper secondary flange to join the ends of the two secondary flange pieces together, but the view in FIG. 8 does not allow this underside plate to be seen. Because the structural property values of steel are affected by heat, if end joints in flanges are made with nail plates as shown in FIG. 8, they should be positioned so as not to occur in a high tensile stress area (e.g. one would expect high tensile stress in the center of a bending span). If nail plate joints will occur in high stressed tensile areas of the box beam flanges, then the beam either must be designed to withstand the stress without help from the secondary flange element or the nail plates themselves must be protected from heat by other means.

In the case where finger-joined lumber or LVL is used for flange material, there is no need for nail-plated end joints in the flanges.

Also illustrated in FIG. 8 are utility holes through the box beam in a direction perpendicular to the planes of the web elements. Cylindrical liners of fire resistant material are bonded at their ends to the web elements so that heat and flame cannot get to the interior of the box beam through the utility holes. The liners can be made of gypsum board or gypsum fiber board molded to fit the cylindrical contours of the holes. Care must be used to avoid weakening the box beam by use of utility holes that are too large or in the wrong place. While calculations involving allowable hole size and location can be quite involved, one can be guided by experience with wood I joists. Some of this information is best verified experimentally for the specific geometry of interest. Bonding of the cylindrical liners not only helps to keep fire away from the beam's interior, but it also helps to preserve the structural integrity of the beams and makes the presence of utility holes less critical structurally for the fire resistant box beam than for I joists or for other box beams not using the liners. In some cases, it may be preferred to use structural cylindrical liners bonded to the plane panel web elements and then protect them with an inner cylindrical liner made of fire resistant material.

In compliance with the statute, the invention has been described in language more or less specific as to structural features. It is to be understood, however, that the invention is not limited to the specified features shown, because the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. An elongated fire resistant box beam having an interleaf portion and an exterior portion comprising:

elongated upper and lower flange means each with a longitudinal axis, and a pair of planar panel web means;

the tipper and lower flange means each comprised of a primary and secondary wooden flange member, the secondary flange being wider than the primary flange;

the planar panel web means comprising at least one layer of fire resistant material, one of the web means being rigidily fastened to one edge the primary flange member of each of the upper and lower flange means, the other web means being rigidly fastened to, the opposite edge of the primary flange member of each of the upper and lower flange means, such that the primary flange member is located within the box beam's interior portion, and the secondary flange is located in the box beam's exterior portion, the resulting shape of the box beam being substantially rectangular in cross-section over the length of the box beam.

2. The box beam of claim 1 wherein each of the pair of web means is comprised of a fire resistant material exposed to the exterior of the box beam and covering a lignocellulosic material exposed to the interior of the box beam, the fire resistant material being selected for its fire resistance and the lignocellulosic material being selected for its structural properties.

3. The box beam of claim 2 wherein the fire resistant material is gypsum.

4. The box beam of claim 1 wherein each of the pair of web means comprises a fibrous composite including gypsum.

5. The box beam of claim 1 additionally comprising longitudinal reinforcement means in each of the upper and lower flange means, the longitudinal reinforcement means adding to the stiffness and strength values of the box beam, the longitudinal reinforcement means being fastened into fire protected areas of the upper and lower flange means.

6. The box beam of claim 5 wherein the longitudinal reinforcement means comprises:

one or more parallel longitudinal reinforcement elements; and a plurality of rib elements attached to each longitudinal reinforcement element.

7. The box beam of claim 6 wherein the rib elements are arranged substantially perpendicular to the longitudinal reinforcement elements and are rigid in compression.

8. The box beam of claim 5 wherein the longitudinal reinforcement means comprises:

a plurality of parallel longitudinal reinforcement elements; and a plurality of cross elements each of which is fastened to every one of the longitudinal reinforcement elements, thus forming a mesh that lies substantially in a plane.

9. The box beam of claim 8 wherein the longitudinal reinforcement means comprises additionally:

a plurality of rib elements, each rib element being rigid in compression and attached to a longitudinal reinforcement element such that the rib element is substantially perpendicular to the plane of the mesh.

10. The box beam of claim 1 additionally comprising utility holes through the box beam in a direction perpendicular to the planes of the web means, the utility holes being lines with cylindrical liners of fire resistant material that is bonded to the web means so that the interior of the box beam is protected from fire.

* * * * *